United States Patent [19]

Wells

[11] Patent Number: 4,791,397

[45] Date of Patent: Dec. 13, 1988

[54] THERMOSTATIC SWITCH CONSTRUCTION

[75] Inventor: Gordon K. Wells, Mansfield, Ohio

[73] Assignee: Therm-O-Disc, Incorporated, Mansfield, Ohio

[21] Appl. No.: 68,617

[22] Filed: Jun. 30, 1987

[51] Int. Cl.[4] ..... H01H 37/04

[52] U.S. Cl. ..... 337/354; 337/372; 337/380

[58] Field of Search ..... 337/354, 372, 380, 112; 361/405, 372, 375; 200/280, 284; 411/402, 417, 418

[56] References Cited

U.S. PATENT DOCUMENTS

| | | | |
|---|---|---|---|
| 3,355,563 | 11/1967 | Ruckriegel | 337/354 |
| 3,832,667 | 8/1974 | Blanton | 337/354 |
| 4,268,812 | 5/1981 | Satterlee | 337/372 |
| 4,446,451 | 5/1984 | Boulanger | 337/380 |
| 4,628,295 | 12/1986 | Yasuda et al. | 337/354 |

*Primary Examiner*—H. Broome

*Attorney, Agent, or Firm*—Polster, Polster and Lucchesi

[57] ABSTRACT

In a snap disc thermostat, a stationary contact support, a moveable contact support, an actuator translated by the disc and a case housing those elements, interior side walls of the case have guide channels outboard of the stationary and moveable contact supports. The actuator has a part substantially circular in section, extending within the guide channels, and a spherical part abutting the moveable contact support. The case has a closed top through which two contact terminals extend, and an open bottom through which the housed elements can be mounted. The open bottom is closed by an imperforate disc. The case has projections integral with the case, extending beyond the rest of the open bottom to center and retain the disc. A disc closure has recessed seats deeper than the projections, receiving the projections without bottoming, a flat surface within the compass of the seats, engaging the disc, and surfaces defining a plane outboard of the seats against which the disc closure abuts. An elongated mounting stud has a shaft, non circular in transverse cross section, with interrupted threads along it, and a non-circular shank projecting into an opening in the disc seating plate, and staked. The stationary contact arm projects from a wall of the case at an acute angle in a direction toward the disc. L shaped terminals can be mounted to provide three predetermined spacings between tabs perpendicular to the feet.

14 Claims, 2 Drawing Sheets

THERMOSTATIC SWITCH CONSTRUCTION

BACKGROUND OF THE INVENTION

This invention has particular application to general purpose bi-metallic disc temperature controls, sometimes called "snap action" temperature controls, but its application is not limited to them.

In conventional small sized bi-metal disc type snap switches, a bumper or actuator operatively connects the disc with a moveable contact arm. In order to guide the bumper, a third piece is sometimes added between the case that houses the various parts and a closure for the case. In others, a bumper guide is molded in the case but the case is left open at both ends so that the switch can be assembled from an end opposite the disc and disc closure. This requires another cover to complete the enclosure. A generally rectangular flat plate is sometimes used as an actuator, riding in guides in the case, but there is a risk of its binding or jamming. A flat plate circular in elevation has also been used, but it tends to cock or tilt, which causes it to "grow", i.e. to increase its effective length between the disc and the switch arm.

One of the objects of this invention is to provide a thermal switch that can be assembled from one end, is simple and inexpensive.

Another object of this invention is to provide such a switch with an actuator that moves smoothly, with little likelihood of wedging, in guides provided, and with minimal effect on gauging as compared with devices known heretofore.

Another object of this invention is to provide a positive means of locating the snap acting disc and keeping it in proper position both during assembly and in use.

Another object of this invention is to provide, in a stud-mounted thermostat, a stud that permits fabrication of the disc closure on a single automatic machine.

Yet another object of this invention is to provide a construction of terminals to fit a variety of standard connectors.

Other objects will become apparent to those skilled in the art in the light of the following description and accompanying drawing.

SUMMARY OF THE INVENTION

In accordance with this invention, generally stated, in a snap-acting thermostat with a snap disc, a stationary contact support carrying a stationary contact and a moveable contact support arm with a moveable contact on it, a bumper mounted for translation by the disc and operatively connecting the disc in the moveable contact and a case housing the snap disc, stationary contact, moveable contact and bumper, interior side walls of the case are provided with guide channels outboard of the stationary and moveable contacts. The bumper has a part substantially circular in transverse section, extending within the compass of the guide means outboard of the contacts. The case has a closed top through which two contact terminals extend, and an open bottom through which the elements enclosed by the case can be mounted. The open mouth has perimetric surfaces lying in a common plane and is closed by an imperforate closure. The case is provided with a plurality of projections integral with the case, extending beyond the rest of the open mouth in a direction away from the case and defining a locating seat for the disc. The disc closure has recessed seats deeper than the projections, receiving the projections without bottoming, a substantially planar surface within the compass of the seats, engaging the disc and surfaces defining a plane outboard of the seats against which a planar surface of the disc closure abuts to close the case. A mounting stud is elongated, with a substantially straight shaft, non circular in transverse cross section, having interrupted threads along a substantial length thereof, and a shank projecting into a complementarily non-circular opening in the disc seating plate, and is staked to lock it in the plate. The stationary contact is supported by an arm having two ends, one end being mounted on the case and the other carrying the stationary contact and projecting from a wall of the case in a direction toward the bumper at an acute angle with respect to the line of translation of the bumper in a direction toward the disc. In the course of assembly, the arm bearing the stationary contact can be bent in a direction toward the perpendicular to gauge the relative positions of the stationary and moveable contacts. L shaped terminals are provided with openings in a foot to receive terminal connectors from the stationary and moveable contacts, the connectors extending through the openings in the closed or integral top of the case. The placement of the opening is such that the L shaped terminals can be mounted to provide three predetermined spacings between legs perpendicular to the feet with the openings in them.

DESCRIPTION OF THE PREFERRED EMBODIMENT

Figure 1:
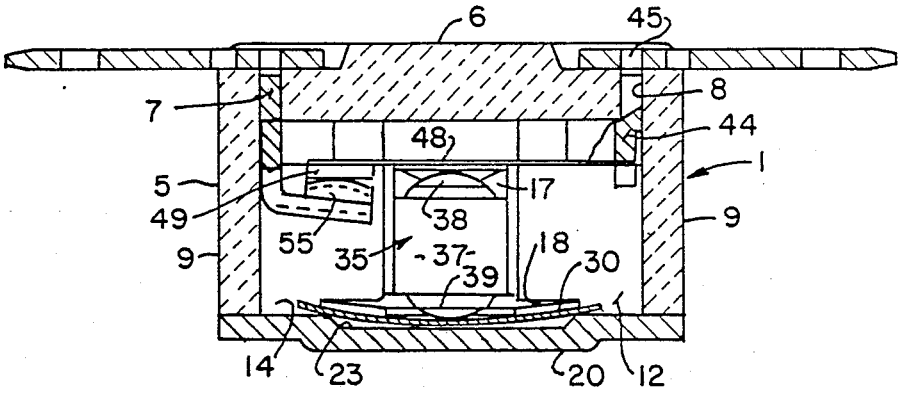
FIG. 1 is a sectional view of one illustrative embodiment of switch of this invention.
Figure 2:
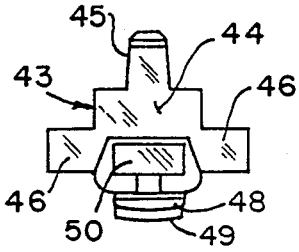
FIG. 2 is a view in rear elevation of an unmounted moveable contact assembly, viewed in the direction from right to left in FIG. 1.
Figure 7:
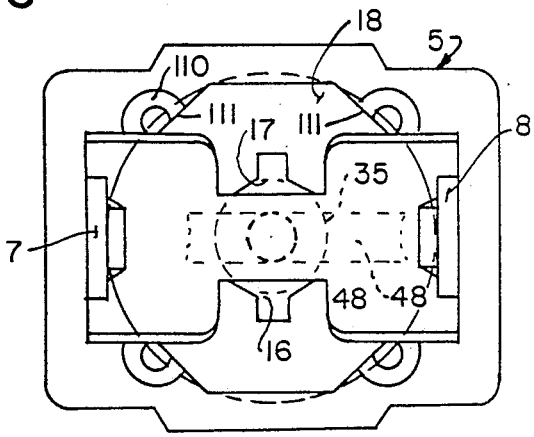
FIG. 7 is a bottom plan view of the empty case of the switch shown in FIG. 1, without a disc closure.
Figure 5:
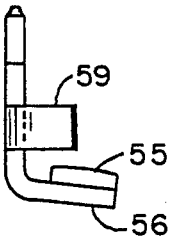
FIG. 5 is a view in side elevation of the fixed contact assembly of FIG. 4.
Figure 6:
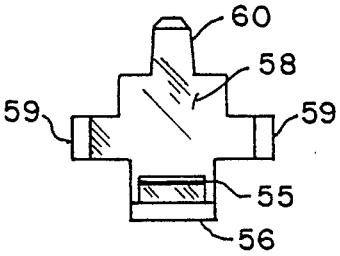
FIG. 6 is a view in front elevation of the fixed contact assembly of FIG. 4.
Figure 8:
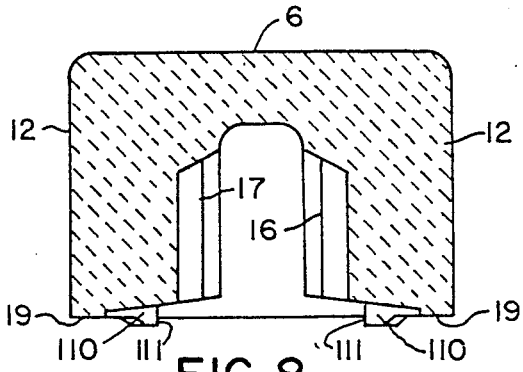
FIG. 8 is a sectional view taken along the line 8—8 of FIG. 11.
Figure 15:
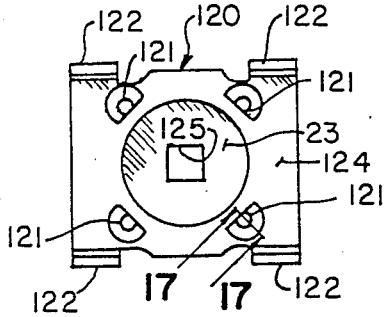
FIG. 15 is a top plan view of a disc closure, reduced in size compared with the views in FIGS. 1–11 but of a size with the device shown in FIG. 12.
Figure 16:
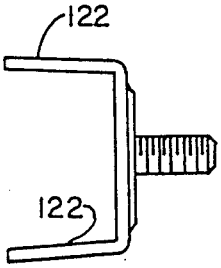
FIG. 16 is a view in side elevation of the disc closure shown in FIG. 15.
Figure 17:
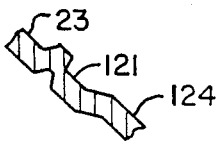
FIG. 17 is a fragmentary sectional view taken along the line 17—17 of FIG. 15.

Referring now to FIGS. 1 through 11, reference numeral 1 indicates an assembled disc type thermal snap switch, which includes a case 5 with a closed top 6 integral with end walls 9 and side walls 12. The closed top 6 has terminal connector openings 7 and 8, immediately adjacent the respective end walls 9. The case 5 is thus a generally rectangular, one-piece box with an open bottom or mouth 14. The side walls 12 have bumper or actuator guide channels 16 and 17 in them, extending from the open mouth 14 toward the top 6, as indicated in FIGS. 1 and 8. The open mouth 14 of the case 5 is closed with a disc closure 20, which has a recessed planar relief area 23, circular in plan, within a planar surface 124. A disc 30 extends into the area 23, but does not bottom thereon, the disc being seated on the edges along which the recessed area 23 meets the planar surface 124. As shown in FIGS. 15 and 16, which illustrate a disc closure that differs from the disc closure shown in FIG. 1 in providing for a stud mounting, the disc closure can be provided with straps that extend along the outside of the side walls and are crimped over a ledge 15 in the outside of the case. This is a conventional way of securing the disc closure to the case 5. The disc closure 20 also has wings or tabs, not here shown, by which the switch is surface mounted, which is a conventional arrangement.

Figure 3:
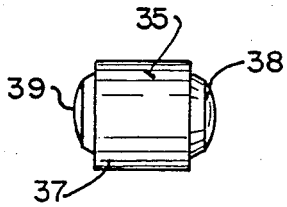
FIG. 3 is a view in side elevation of a bumper.
Figure 3A:
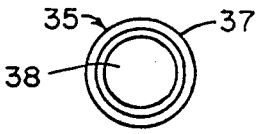
FIG. 3A is a view in end elevation of the bumper shown in FIG. 3.
Figure 4:
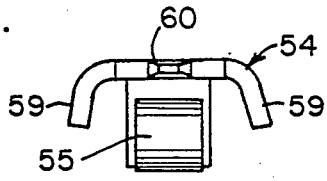
FIG. 4 is a top plan view of an unmounted fixed contact assembly.

Within the case 5, a bumper or actuator 35, which in the embodiment shown in FIGS. 1, 3 and 3A has a cylindrical mid section 37 and spherically curved end sections 38 and 39, is closely but freely slidably mounted between and extending within the guide channels 16 and 17. The bumper 35 bridges between and connects operatively the disc 30 and a moveable contact arm 48 of a moveable contact assembly 43. The moveable contact assembly 43 includes a terminal connector plate 44 with stablizing wings 46, a terminal connector finger 45 projecting through the terminal connector opening 8 in the closed top 6, and a contact 49. The contact arm 48 is bent up at its end opposite the contact 49 to provide a lip 50 which is spot welded to the connector plate 44. The moveable contact assembly is mounted in the case, with the wings 46 in channels in the body, and the finger 45 extending through the opening 8 and projecting far enough above the outer surface of the top 6 to permit its securement to a terminal, as shown in FIG. 1.

A fixed contact assembly 54 is mounted on the inside surface of the opposite end wall 9 from the terminal connector plate 44. The fixed contact assembly 54 includes a fixed contact 55 mounted on a fixed contact arm 56. The fixed contact arm 56 is a part of a fixed contact terminal plate 58, which includes, besides the arm 56, wings 59 and a contact terminal connector finger 60. The fixed contact assembly 54 is mounted in the case, with the finger 60 projecting through the opening 7 in the top of the case and the wings 59 engaging channel-defining surfaces in the side walls 12, corresponding to the channels in which the moveable contact assembly is mounted.

The general construction and mounting of both the moveable contact assembly 43 and the fixed mounting assembly 54 are conventional. The exception is in the construction of the fixed contact arm 56, which, in this embodiment, makes an acute angle with the long axis or axis of translation of the bumper 35, in a direction toward the disc 30.

Figure 9:
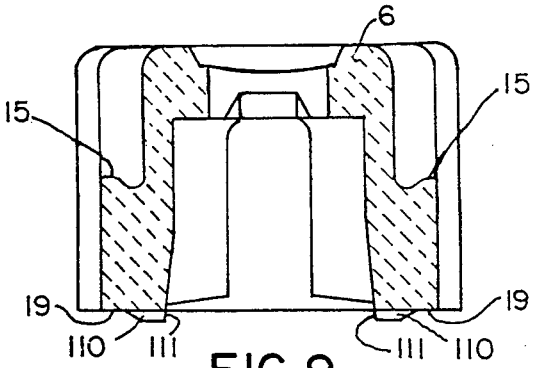
FIG. 9 is a sectional view taken along the line 9—9 of FIG. 11.
Figure 10:
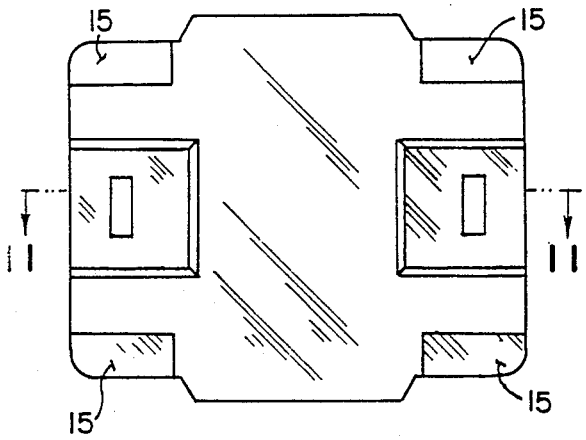
FIG. 10 is a top plan view of the case shown in FIG. 7, without terminals.
Figure 11:
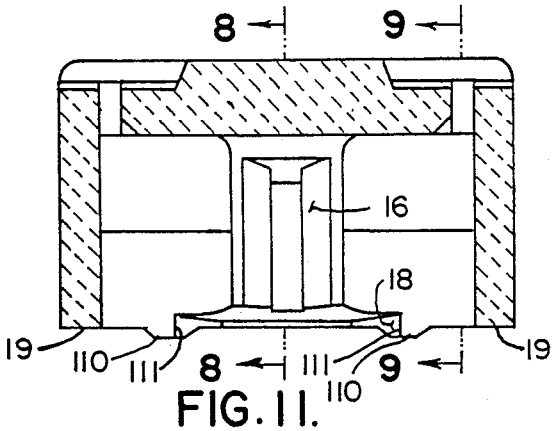
FIG. 11 is a sectional view taken along the line 11—11 of FIG. 10.

As shown particularly in FIGS. 8, 9 and 11, the outer margins of the open bottom 14 lie in the same plane. Inboard of the margins, and flanking a recessed seat 18 are 4 projections 110, each with a centering face 111.

The moveable contact arm 48 is narrower in the transverse dimension than the diameter of the cylindrical portion 37 of the bumper 35, as indicated in FIG. 7. That cylindrical portion 37 is slideably caged within the guide channels 16 and 17, as also indicated in that figure.

In assembling this embodiment of switch, the empty case is oriented with the open bottom facing upward. The moveable contact assembly is fit in place in the conventional way, followed by the fixed contact assembly. The bumper 35 is then slid into place in the guide channels 16 and 17. If there is any variation in the effective length of the bumper, or in the position of the moveable contact 49 with respect to the fixed contact 55, a gauging tool can be arranged automatically to bend the arm 56 toward the horizontal to the desired position. The disc 30 is then placed in the locating seat defined by the faces 111 of the projections 110, where it will be retained while the disc closure 20 is mounted. The disc closure 20 is, in all respects save the provision of a mounting stud, the same as the disc closure 120 of the embodiment next to be described.

Referring now to FIGS. 12 through 17, reference numeral 101 indicates a second embodiment of switch of this invention identical with the embodiment shown in FIGS. 1 through 11 except for the provision of a spherical bumper or actuator 135 and a mounting stud 127, the latter requiring means for mounting the stud in the disc closure. In this embodiment, a disc closure 120 is identical with the disc closure 20 of the first embodiment, except for the provision of a square opening 125 in the center of the planar recessed area 23. The disc closure 120 has a planar area 124 surrounding the disc relief area 23 and adapted to close completely the open bottom of the case 5. Straps 122, are crimped over ledges 15 shown in FIGS. 9 and 10. Recessed seats or pockets 121 are positioned and shaped complementarily to the projections 110 on the case, but are deeper than the projections, so that the projections do not bottom out in the seats 121. This ensures that the planar area 124 butts a flat surface 19 of the side and end walls which defines a plane around the open bottom, outboard of the projections 110, so that the disc closure totally closes the open bottom. At the same time, the extension of the projections 110 into the recesses 121 below the level of the planar surface 124 of the disc closure 20 ensures the continued proper location of the disc with respect to the bumper after the device is assembled.

Conventionally, the disc is either located in a shallow well in the case or in a separate piece between the case and the disc closure, in which case it is easy for the disc to slip out of position, or else detents are formed in the disc closure to keep the disc centered. In the latter arrangement, the disc is supported on a set of pads, which has a detrimental effect on the heat transfer to the disc. In the present construction, because the closure always mates with the case on the flat surfaces outboard of the recesses, and the edge of the disc relief being the support surface for the disc, the construction of the device of this invention provides reliable gauging and consistent thermal response. At the same time, because the seats 121 are merely recessed and do not involve openings, it provides a totally enclosed package as well.

Figure 12:
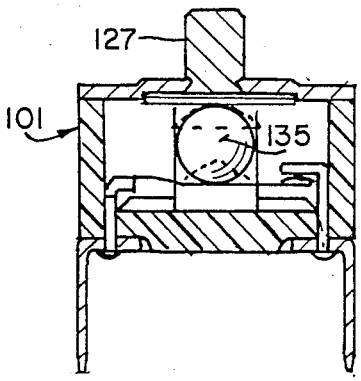
FIG. 12 is a sectional view of another embodiment of switch of this invention.
Figure 13:
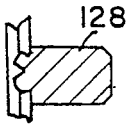
FIG. 13 is a fragmentary sectional view of the stud shown in FIG. 12, staked into a disc closure plate.
Figure 14:
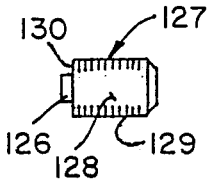
FIG. 14 is a view in side elevation of the stud before it is mounted in the plate.

In the particular embodiment of stud mounted switch shown in FIGS. 12 through 17, the square hole 125 receives a square shank 126 of a stud 127. The stud has a shaft 128 with interrupted threads 129 through most of its length. The shank 126 is initially square and the shaft 128 is initially rectangular. The shank 126 is reduced with respect to the shaft to provide a shoulder 130. Accordingly, in the embodiment illustrated, the threads 129 are interrupted on all four flat sides of the shaft. As shown in FIG. 13, the shank 126 is inserted in the opening 125 and staked to secure it to the disc closure. The advantages of the use of the spherical bumper include the availability of accurately formed spheres, the fact that they require no orientation for their insertion, the fact that they move with a minimum of friction, and that their rotation has no effect on their gauging. The advantage of the square shanked stud is that the disc closure and stud can be made and assembled automatically on a single machine.

Figure 18A:
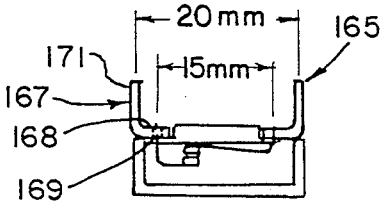
FIG. 18A is a somewhat schematic drawing showing one position of mounting of terminals on the switch of this invention.
Figure 18B:
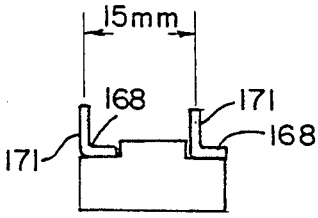
FIG. 18B is a view in side elevation showing one alternative orientation of mounting of the terminals.
Figure 18C:
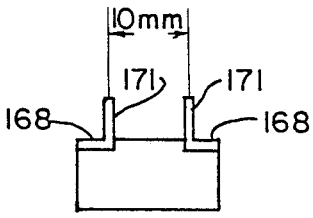
FIG. 18C is a view in side elevation showing still another orientation of mounting of the terminals.

Referring now to FIGS. 18A through 18C, a terminal assembly 165 is provided that is particularly adapted to use with "multi-fit" connectors which have receptacle spacings on increments of 5 millimeters. To accomplish this, the terminal assembly 165 is made up of two L-shaped blades 167, each with a foot 168 and an outwardly projecting leg tab or blade 171. The foot 168 has in it a finger receiving opening formed to receive either the fixed contact terminal connector finger 60 or the moveable contact terminal finger 45, the two fingers being identically dimensioned at their outer ends. The finger receiving opening is centered in the direction lengthwise of the foot 168 exactly 2½ millimeters from the center line in the direction of its width of the outwardly projecting leg 171. Thus, when the terminals are oriented as shown in FIG. 18A, the distance between the center line of outwardly projecting legs 171 is 20 millimeters; when oriented as in FIG. 18B, 15 millimeters, and when oriented as in FIG. 18C, 10 millimeters. In this way, the same terminal blades can be used to provide a terminal assembly that will fit three different standard connectors. The case in each embodiment is made with a seat dimensioned to receive the terminal foot in either orientation, as indicated in FIG. 12 as well as in FIGS. 18A–18C.

Numerous variations in the construction of the device of this invention, within the scope of the appended claims, will be apparent to those skilled in the art in the light of the foregoing disclosure. Merely by way of example, the transverse cross sectional shape of the stud can be varied, provided that the shank is non-circular. The case can be of different shapes and dimensions. It can even be cylindrical, with guide channels on diametrically opposed surfaces. The number of projections and corresponding seats can vary from three to more than four, and their particular configurations can vary, as long as they do not bottom in the disc closure recesses. It can be appreciated that the disc closure can be provided with wings for surface mounting or for a clip mount, or have a welded clip for a pipe mount or welded strap for surface mounting.

The bumper can assume various shapes in transverse section, as, for example, an oval shape, but for ease of manufacture and ready availability, preferably, either a cylindrical bumper with spherical contact faces or, a spherical bumper, has many advantages. The stud mounting arrangement is particularly useful with the thermostat switch of this invention, but has ther applications. The L-shaped terminals adaptable to three different standard connectors can also be incorporated into other controls and the like, and instead of the fingers, the locating means can take the form of rivets, or sockets into which a toe, depending from the end of the foot, projects, for example. These variations are merely illustrative.

I claim:

1. In a snap-acting thermostat having snap disc means; switch means including stationary contact support means and a stationary contact supported thereby and a movable contact support arm and a movable contact supported thereby; an actuator mounted for translation by said disc means and operatively connecting said disc and said movable contact, and a case housing said snap disc means, stationary contact, movable contact and actuator, said case having a top wall, side walls and end walls, and an open bottom, and a closure closing the open bottom of said case, the improvement comprising interior side walls of said case on either side of said contacts, guide means in the form of guide channels in and integral with said side walls, said guide means facing one another and being on opposite sides of, spaced from and wholly outboard of said movable contact arm and spaced from one another with respect to said movable contact arm, said actuator having a part, substantially circular in section, extending within a compass of said guide means outboard of said contacts, said guide means constituting a sole guide for said actuator, and said case and closure constituting a complete enclosure of only two separate parts.

2. The improvement of claim 1 wherein the bumper is cylindrical through a center section, with spherical end parts.

3. The improvement of claim 1 wherein the bumper is spherical.

4. In a snap-acting thermostat having snap disc means, switch means including a stationary contact support means and a stationary contact supported thereby and a movable contact support arm and a movable contact supported thereby; an actuator mounted for translation by said disc means and operatively connecting said disc and said movable contact, a case housing said snap disc, stationary contact, movable contact and actuator, and a disc closure having a mounting stud projecting in a direction away form said case, the improvement comprising said stud being elongated and axially, substantially straight, non-circular in transverse cross-section, having interrupted threads along a substantial length thereof, said stud having a non-circular shank projecting into an opening in said disc closure and staked to lock it in said plate.

5. The improvement of claim 4 wherein the stud is rectangular in transverse cross-section and the opening is complementarily rectangular.

6. In a mounting comprising a plate with a mounting stud projecting thereform, the improvement comprising said stud being elongated and axially, substantially straight, non-circular in transverse cross-section, having interrupted threads along a substantial length thereof, said stud having a shank projecting into a complementarily non-circular opening in said plate and staked to lock it in said plate.

7. In a snap-acting thermostat having snap disc means; switch means including stationary contact support means and a stationary contact supported thereby and a movable contact support arm and a movable contact supported thereby; a bumper mounted for translation by said disc means and operatively connecting said disc and said movable contact, a case housing said snap disc, stationary contact, movable contact and bumper, and an imperforate disc closure, said case having an open bottom, defined by surface lying in a common plane, closed by said disc closure, the improvement comprising a plurality of projections integral with said case, extending beyond said open bottom in a direction away from said case and defining a seat for said disc, said disc closure having recessed seats deeper than said projections, receiving said projections without bottoming, and a substantially planar surface within the compass of said seats, engaging said disc.

8. In a snap-acting thermostat having snap disc means; switch means including stationary contact support means and a stationary contact supported thereby and a movable contact support arm and a movable contact supported thereby; an actuator mounted for translation by said disc means and operativley connected said disc and said movable contact, and a case housing said snap disc, stationary contact, movable contact and actuator, the improvement comprising interior side walls of said case on either side of said contacts, guide means in the form of guide channels in and integral with said side walls, said guide means facing one another and being on opposite sides of and wholly outboard of said movable contact arm, and spaced from one another and from said contact arm, said actuator having a part, substantially circular in section, extending within a compass of said guide means outboard of said contacts, said guide means constituting a sole guide for said actuator, said stationary contact support means being accessible to a gauging tool from the open bottom of the case before the closure is put into place, said stationary contact means including an arm having two ends, one end being mounted on said case and the other end carrying said stationary contact and projecting from a wall of said case in a direction toward said actuator at an acute angle with respect to the line of translation of said actuator in a direction toward said disc, whereby said stationary contact can be bent upwardly to gauge the operating clearances of the disc-actuator-movable contact mechanism.

9. In a snap-acting thermostat having snap disc means; switch means including stationary contact support means with an arm with a part with a terminal connector connected thereto and a part with a stationary contact supported thereby and a movable contact support arm electrically connected to a terminal connector, said support arm carrying a movable contact; a bumper mounted for translation by said disc means and operatively connecting said disc and said movable contact arm, and a case housing said snap disc, stationary contact, movable contact and bumper, said case having a top wall with terminal connector apertures in it, spaced from one another, the improvement comprising a finger of one of said stationary and movable contact terminal connectors extending through one of said apertures and a finger of the other of said terminal connectors extending through the other of said apertures, said apertures being 15 millimeters apart, center to center, and two terminals, L-shaped in side elevation, each with an outwardly projecting leg and a foot with a terminal connector opening in it receiving one of said terminal connector fingers, said openings being 2.5 millimeters from the center of the outwardly projecting leg, thicknesswise, whereby, depending upon the orientation of said terminals with respect to one another, they can be spaced 10, 15 or 20 millimeters apart.

10. In a snap-acting thermostat having snap disc means; switch means including stationary contact support means and a stationary contact supported thereby and a movable contact support arm and a movable contact supported thereby; a bumper mounted for translation by said disc means and operatively connecting said disc and said movable contact, and a case housing said snap disc means, stationary contact, movable contact and bumper, the improvement comprising interior side walls of said case on either side of said contacts, guide means in each of said side walls outboard of said moveable contact arm, said bumper having a part, substantially circular in section, extending within the compass of said guide means outboard of said contacts; an imperforate disc closure, said case having an open mouth closed by said disc closure, a plurality of projections integral with said case, extending beyond said open end in a direction away from said case and defining a seat for said disc, said disc closure having recessed seats deeper than said projections, receiving said projections without bottoming, a substantially planar surface within the compass of said seats, engaging said disc, and a substantially planar surface outboard of the said seats, engaging planar surfaces defining said open mouth of said case.

11. The improvement of claim 10 wherein said stationary contact means includes an arm having two ends, one being mounted on said case and the other carrying said stationary contact and projecting from a wall of said case in a direction toward said bumper at an acute angle with respect to the line of translation of said bumper in a direction toward said disc.

12. The improvement of claim 10 wherein said case top wall has terminal connector apertures in it, spaced from one another, a finger of one of said stationary and moveable contact terminal connectors extending through one of said apertures and a finger of the other said terminal connectors extending through the other of said apertures, said apertures being 15 millimeters apart, center to center, and two terminals, L-shaped in side elevation, each with an outwardly projecting leg and a foot with a terminal connector opening in it receiving one of said terminal connector fingers, said terminal connector openings being 2.5 millimeters from the center of the outwardly projecting leg, thicknesswise, whereby, depending upon the orientation of said terminals with respect to one another, they can be spaced 10, 15 or 20 millimeters apart.

13. The improvement of claim 7 wherein the open bottom of said case is defined by surfaces lying in a common plane, and said disc closure has a planar surface outboard of said seats, engaging said bottom-defining planar surfaces.

14. In a control or the like having a casing housing elements of an electrical circuit to which electric power is to be supplied, plug-in terminals mounted on said casing and electrically connected to said elements, said plug-in terminals having male tabs, arranged to extend into female connector sockets, the improvement comprising two mounting means, spaced 15 millimeters apart, on said casing, and two of said plug-in terminals, L-shaped in side elevation, each with an outwardly projecting tab and a foot contiguous said casing, said foot having attachment means complementary to said mounting means, spaced 2.5 millimeters from the center of the outwardly projecting tab, thicknesswise, whereby, depending upon the orientation of the terminals with respect to one another, the tabs can be spaced 10, 15 or 20 millimeters apart.

* * * * *